US009138119B1

(12) United States Patent
Bantum

(10) Patent No.: US 9,138,119 B1
(45) Date of Patent: Sep. 22, 2015

(54) AIR DUCT FOR AN EXTRACTOR CLEANING MACHINE

(71) Applicant: TECHTRONIC INDUSTRIES CO. LTD., Tsuen Wan, New Territories (HK)

(72) Inventor: John Bantum, Munroe Falls, OH (US)

(73) Assignee: Techtronic Industries Co. Ltd., Tsuen Wan, New Territories (HK)

( * ) Notice: Subject to any disclaimer, the term of this patent is extended or adjusted under 35 U.S.C. 154(b) by 6 days.

(21) Appl. No.: 14/208,835

(22) Filed: Mar. 13, 2014

(51) Int. Cl.
*A47L 11/34* (2006.01)
*A47L 11/40* (2006.01)

(52) U.S. Cl.
CPC ..... *A47L 11/34* (2013.01); *A47L 11/4083* (2013.01); *A47L 11/4088* (2013.01)

(58) Field of Classification Search
CPC . A47L 11/34; A47L 11/4044; A47L 11/4088; A47L 11/4083; A47L 11/4016
See application file for complete search history.

(56) References Cited

U.S. PATENT DOCUMENTS

| | | | | |
|---|---|---|---|---|
| 5,548,866 | A | 8/1996 | Reed et al. | |
| 5,784,755 | A * | 7/1998 | Karr et al. | 15/334 |
| 5,983,442 | A * | 11/1999 | Louis et al. | 15/320 |
| 6,167,586 | B1 * | 1/2001 | Reed et al. | 15/320 |
| 6,412,141 | B2 * | 7/2002 | Kasper et al. | 15/320 |
| 6,513,188 | B2 * | 2/2003 | Zahuranec et al. | 15/320 |
| 6,536,071 | B2 | 3/2003 | Zahuranec et al. | |
| 7,269,879 | B2 * | 9/2007 | Kegg et al. | 15/320 |
| 7,322,071 | B2 * | 1/2008 | Lee et al. | 15/320 |
| 7,617,563 | B2 | 11/2009 | Hertrick et al. | |
| 7,644,470 | B2 * | 1/2010 | Lee et al. | 15/320 |
| 7,823,250 | B2 | 11/2010 | Vander Baan | |
| 8,230,549 | B2 | 7/2012 | Lenkiewicz et al. | |
| 8,370,991 | B2 | 2/2013 | Paliobeis et al. | |
| 9,015,898 | B2 * | 4/2015 | Nguyen | 15/320 |
| 2003/0226230 | A1 * | 12/2003 | Hertrick et al. | 15/320 |
| 2006/0185113 | A1 | 8/2006 | Kloeppel et al. | |
| 2007/0234503 | A1 * | 10/2007 | Krebs et al. | 15/331 |
| 2012/0066858 | A1 | 3/2012 | Krondorfer et al. | |
| 2012/0222235 | A1 | 9/2012 | Lenkiewicz et al. | |

* cited by examiner

*Primary Examiner* — Dung Van Nguyen
(74) *Attorney, Agent, or Firm* — Michael Best & Friedrich LLP

(57) ABSTRACT

An extractor cleaning machine that includes a base having a suction nozzle and a body coupled to the base. The extractor cleaning machine also includes a suction source in fluid communication with the suction nozzle. The extractor cleaning machine further includes a recovery tank configured to store fluid and dirt drawn through the suction nozzle, and a tank tray coupled to at least one of the base and the body. The tank tray including a top surface and a bottom surface. The recovery tank is coupled to the tank tray adjacent the top surface. The extractor cleaning machine also includes an air duct coupled to the tank tray adjacent the bottom surface to define a passageway that fluidly couples the recovery tank and the suction nozzle.

20 Claims, 5 Drawing Sheets

AIR DUCT FOR AN EXTRACTOR CLEANING MACHINE

BACKGROUND

The present invention relates to extractor cleaning machines and, more particularly, to air ducts for extractor cleaning machines.

An extractor cleaning machine typically includes a recovery tank for recovering liquids and dirt drawn off of a surface being cleaned by a suction nozzle. An air duct fluidly connects the recovery tank and the suction nozzle.

SUMMARY

In one aspect, the invention includes an extractor cleaning machine having a base movable along a surface to be cleaned. The base includes a suction nozzle. The extractor cleaning machine further includes a body coupled to the base. The extractor cleaning machine also includes a suction source in fluid communication with the suction nozzle. The suction source is operable to draw fluid and dirt from the surface through the suction nozzle. The extractor cleaning machine further includes a recovery tank configured to store the fluid and dirt drawn through the suction nozzle and a tank tray coupled to at least one of the base and the body. The tank tray including a top surface and a bottom surface. The recovery tank is coupled to the tank tray adjacent the top surface. The extractor cleaning machine also includes an air duct having a duct inlet and a duct outlet. The air duct is coupled to the tank tray to define a passageway that fluidly couples the recovery tank and the suction nozzle.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
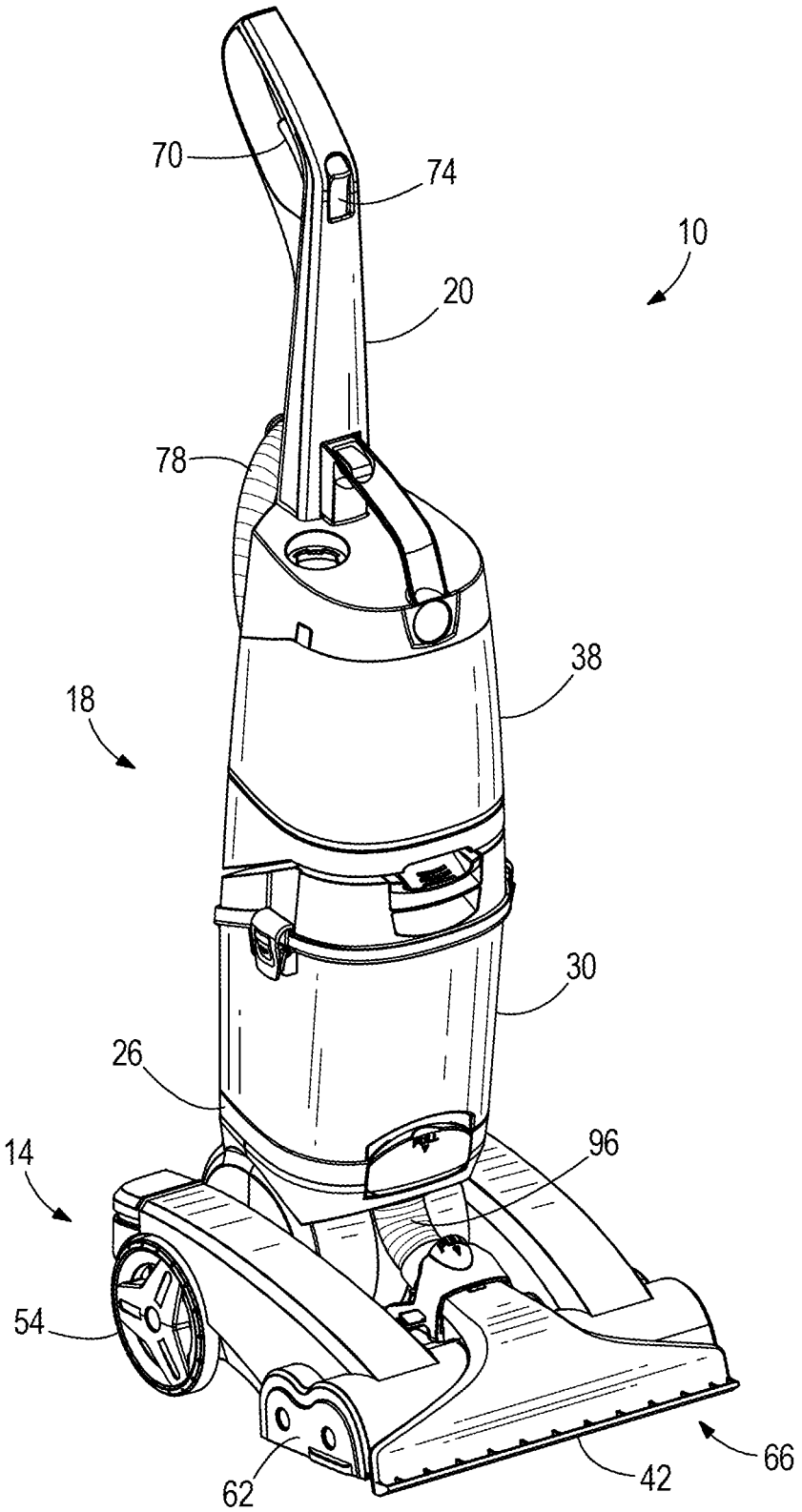
FIG. 1 is a perspective view of an extractor cleaning machine according to one embodiment of the invention.

FIG. 1 illustrates an extractor cleaning machine 10 (hereinafter referred to simply as an "extractor"). In the illustrated embodiment, the extractor 10 is an upright extractor operable to clean a surface, such as, for example, a floor. In some embodiments, the extractor 10 may be adapted to clean a variety of surfaces, such as carpets, hardwood floors, tiles, or the like. The extractor 10 distributes or sprays a cleaning fluid (e.g., water, detergent, or a mixture of water and detergent) onto the surface to clean the surface. The extractor 10 then draws the cleaning fluid and dirt off of the surface, leaving the surface relatively clean.

Figure 2:
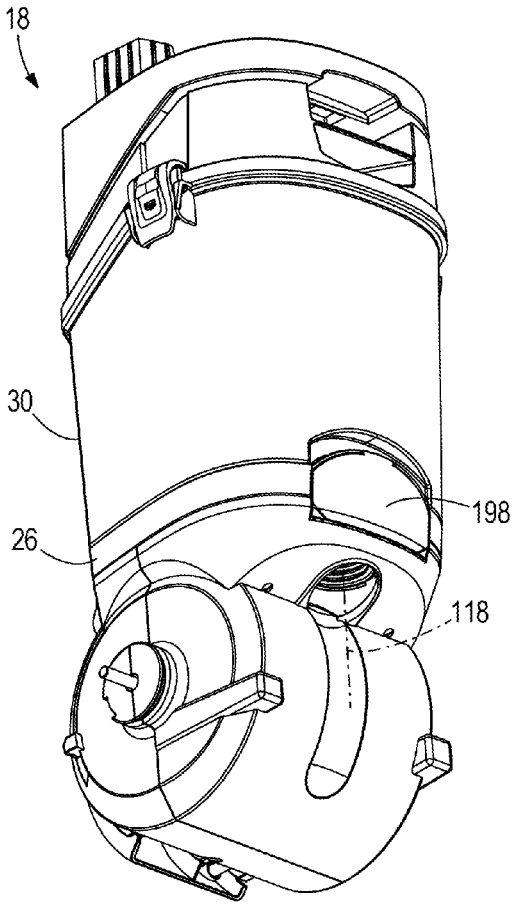
FIG. 2 is a perspective view of a portion of the extractor cleaning machine shown in FIG. 1 with a base removed.
Figure 3:
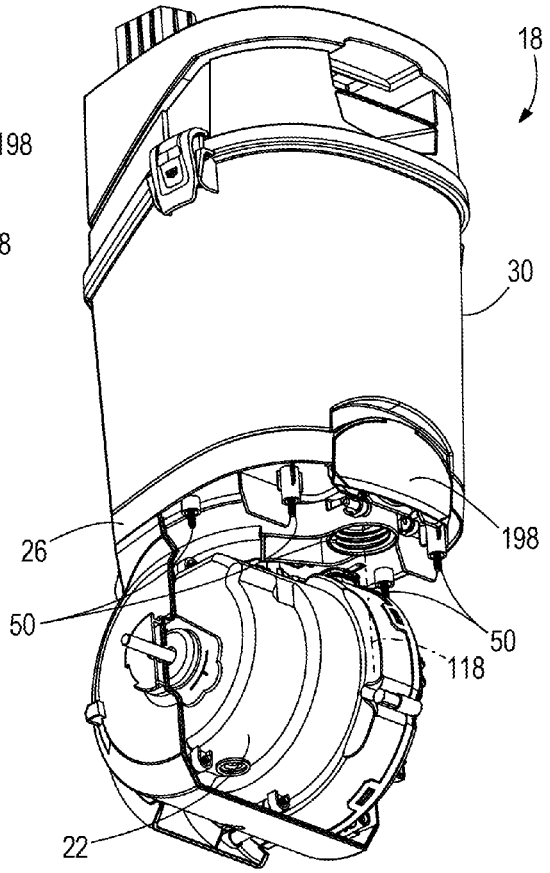
FIG. 3 is a perspective view of a portion of the extractor cleaning machine shown in FIG. 2 with a portion of a body removed.

The illustrated extractor 10 includes a base 14 (other extractors such as non-upright-type extractors, might include a different type of base), a body 18 coupled to the base 14 and the body 18 including a handle 20. The extractor 10 further includes a suction source 22 supported by the body 18 (FIG. 3), a tank tray 26, a recovery tank 30 supported by the tank tray 26 (FIG. 2), a distribution system (not shown), and a supply tank assembly 38 coupled to the body 18. In the illustrated embodiment, the suction source 22 is generally underneath the recovery tank 30 (FIG. 3). In other embodiments, the suction source 22 may be supported by the body 18 or may be positioned elsewhere on the extractor 10. In one embodiment, the suction source 22 includes an electric motor and a fan. The motor rotates the fan to generate airflow.

Figure 4:
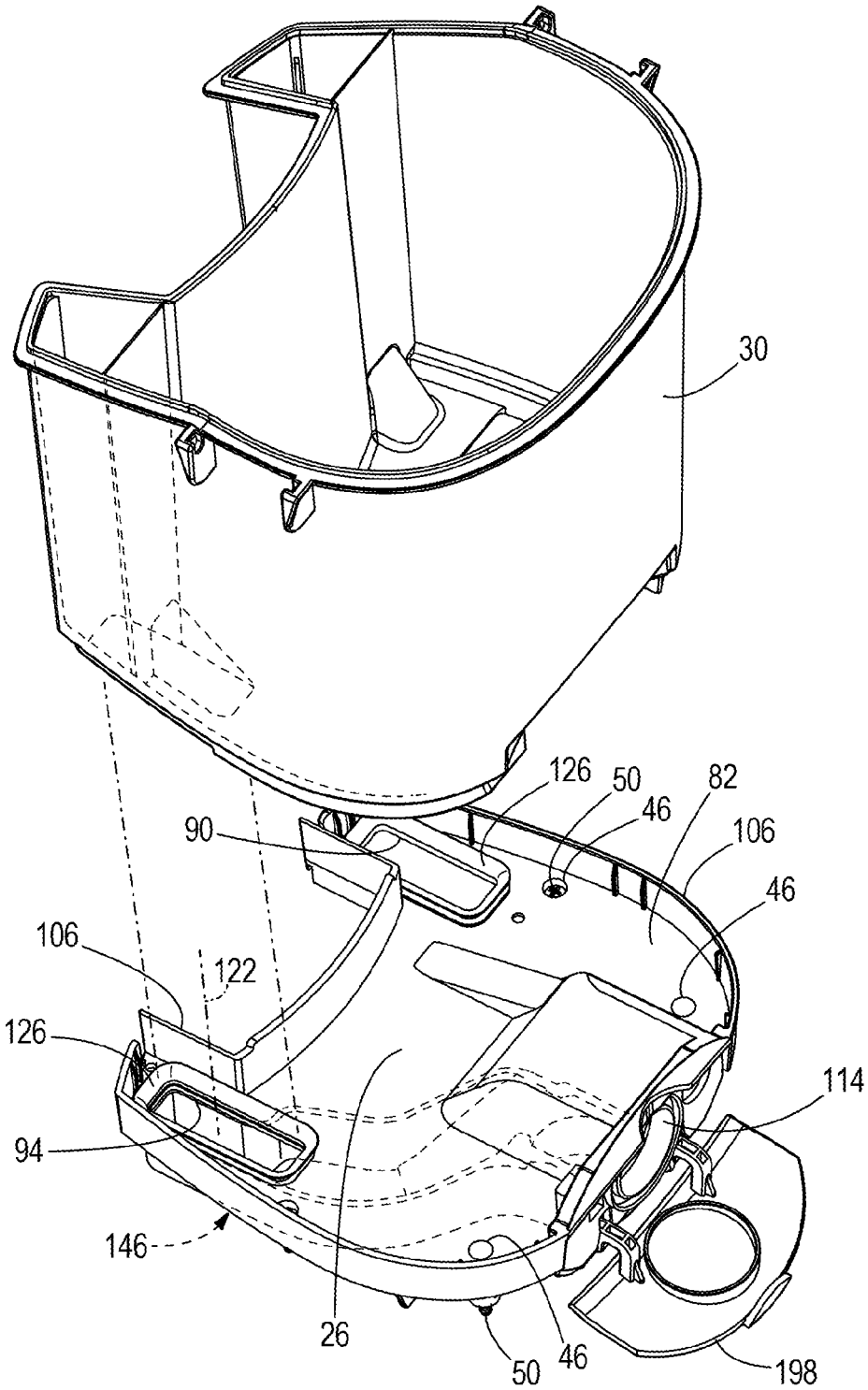
FIG. 4 is an exploded perspective view of a portion of the extractor cleaning machine shown in FIG. 1 including a tank tray and a recovery tank.

Referring to FIGS. 3 and 4, the tank tray 26 is positioned between the recovery tank 30 and the base 14 while in contact with and supporting the recovery tank 30. In the illustrated embodiment, the tank tray 26 is fixed to the body 18 with fasteners 50 received in screw embossments 46 cooperating with mating portions of the body. Alternatively, the tank tray may be attached by other fastening techniques. In addition, the tank tray 26 extends from the handle 20 at a generally normal orientation to the handle 20 in the illustrated embodiment. In other embodiments, the tank tray 26 may be coupled to the base 14.

The base 14 is movable along the surface to be cleaned. Two or more wheels 54 (only one of which is shown in FIG. 1) may be coupled to the base 14 to facilitate movement of the base 14 along the surface. In the illustrated embodiment, the wheels 54 are idle wheels. In other embodiments, the wheels 54 may be driven wheels.

In continued reference to FIG. 1, the base 14 further includes a suction nozzle 42 and a brush assembly 62 adjacent a lower surface 66 of the base 14. The suction nozzle 42 draws fluid and dirt from the surface via the suction source 22 into the recovery tank 30. The brush assembly 62 is adjacent the suction nozzle 42 to scrub the surface. The brush assembly 62 also helps inhibit fluid from flowing beyond a periphery of the base 14. In some embodiments, individual brushes of the brush assembly 62 may be electrically or pneumatically rotated to agitate and scrub the surface.

The fluid distribution system is in fluid communication with the supply tank assembly 38 to draw cleaning fluid from the supply tank assembly 38 and distribute the fluid to the surface. In some embodiments, the fluid distribution system may include a pump that propels the cleaning fluid to the surface.

The illustrated body 18 is pivotally coupled to and extends from the base 14. The body 18 is pivotable or tiltable relative to the base 14 from a generally vertical, or upright, storage position show in FIG. 1 to one or more non-vertical, or inclined, operating positions. Pivoting the body 18 to an operating position facilitates moving the base 14 along the surface.

As shown in FIG. 1, the body 18 supports a trigger 70 and optionally a mode switch 74. The trigger 70 is actuatable to spray cleaning fluid from the supply tank assembly 38 through the distribution system onto the surface. The mode switch 74 adjusts the operating mode (i.e., wash, rinse, autorinse, etc.) of the extractor 10. The illustrated body 18 also supports an auxiliary hose 78. The auxiliary hose 78 is connectable to a variety of hand-held tools to clean smaller surfaces, such as, for example, steps.

Figure 5:
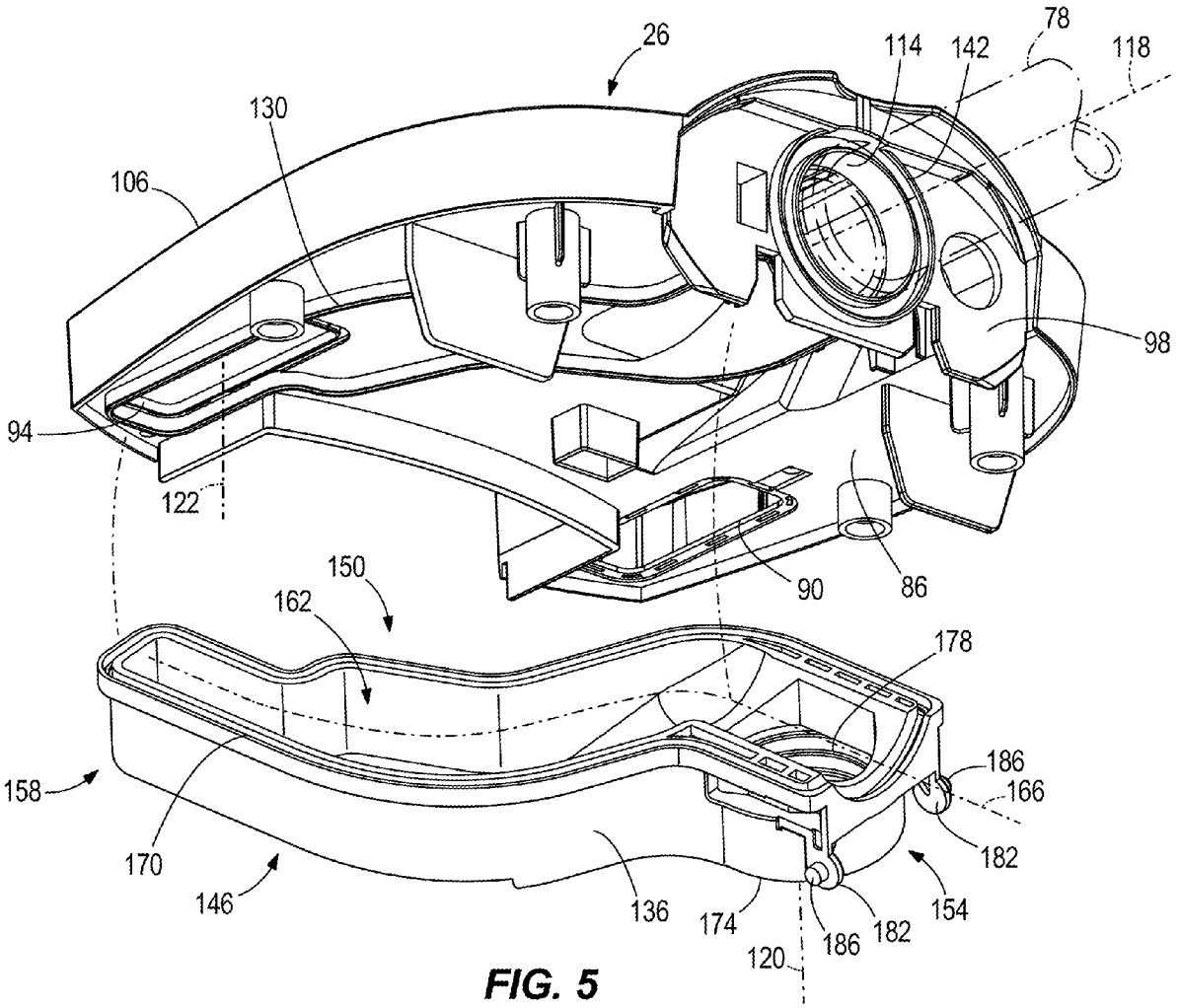
FIG. 5 is an exploded perspective view of a portion of the extractor cleaning machine shown in FIG. 1 including an air duct and the tank tray.
Figure 6:
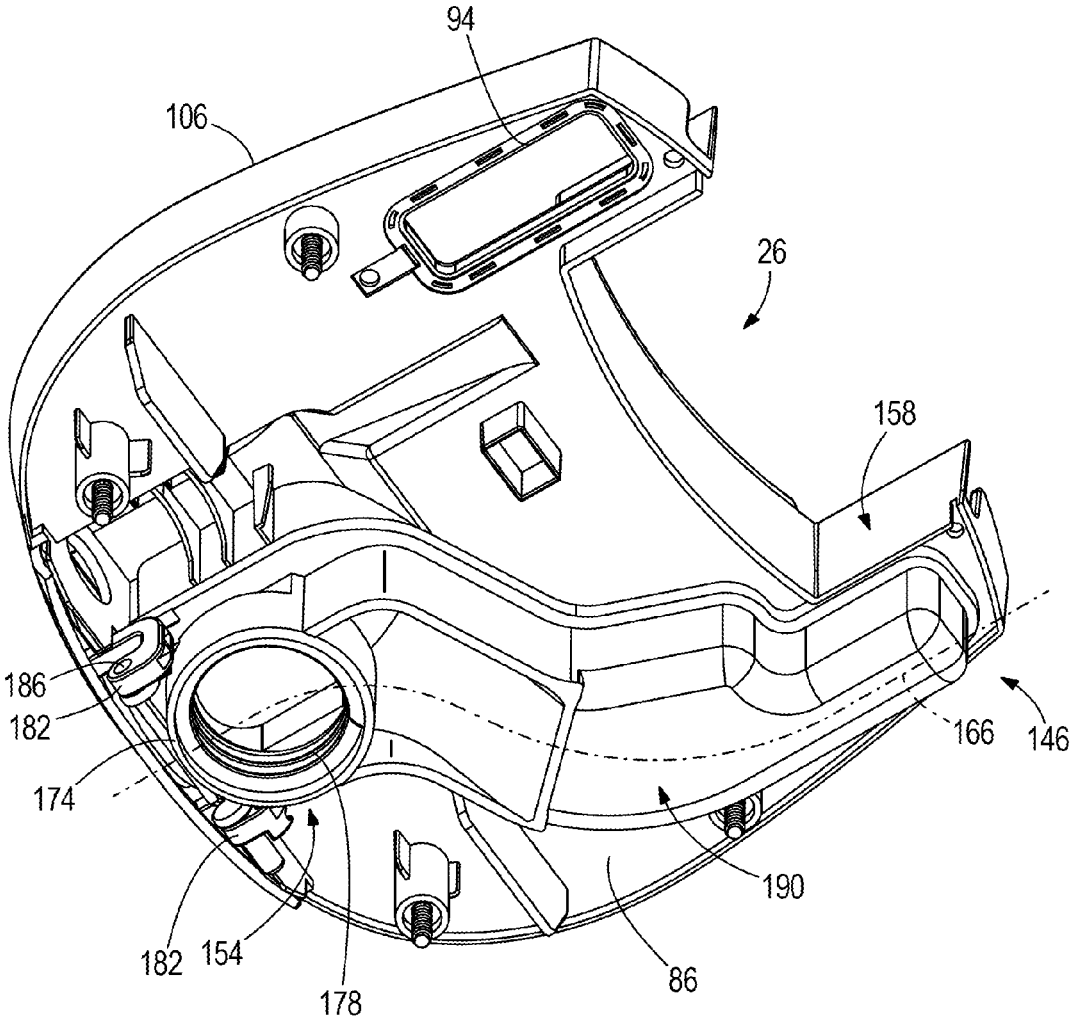
FIG. 6 is a perspective view of the air duct attached to the tank tray.

FIG. 4 illustrates the tank tray 26 and the recovery tank 30 separately detached from the extractor 10. Referring to FIGS. 4-6, the tank tray 26 includes a top surface 82 that supports the recovery tank 30, a bottom surface 86 opposite of the top surface 82, and an air duct 146 coupled to the tank tray 26 to define a passageway that fluidly couples the recovery tank 130 and the suction nozzle 42. In the illustrated embodiment shown in FIG. 1, a tube 96 connects the suction nozzle 42 to the air duct 146.

As shown in FIG. 4, the tank tray 26 may include a tank inlet aperture 94 in fluid communication with an outlet of the air duct 146 and an inlet of the recovery tank 30. Optionally, the tank tray may include an air passage outlet aperture 90 positioned near the body 18 when the tank tray 26 is attached to the extractor 10. The apertures 90, 94 provide communication through the tank tray 26 and may be configured and located as desired for the application, such as in various geometries such as rectangular, circular, square, etc. The tank inlet aperture 94 defines an axis 122 and provides fluid flow to the recovery tank 30 while the air passage aperture 90 receives air flow exhausting from the recovery tank 30. Furthermore, fluid-sealing gaskets 126 are located on the top surface 82 adjacent the apertures 90, 94 in generally the same geometric configuration as the apertures 90, 94. In alternative embodiments, the airflow entering the recovery tank or exhausting from the recovery tank may be routed in a path that does not pass through the tank tray.

The illustrated tank tray 26 further includes a wall 106 that provides a perimeter around at least a portion of the tank tray 26. The wall 106 enables the recovery tank 30 to be easily received on the tank tray 26 when the recovery tank 30 is removed and attached to the tray 26. In the illustrated embodiment, an auxiliary tool inlet 114 is located adjacent the wall 106 at the front of the tray 26 and defines an inlet axis 118 (FIG. 5).

In operation, the suction source 22 generates an airflow that is drawn through the suction nozzle 42. If cleaning fluid from the supply tank assembly 38 was sprayed onto the surface, then the suction source 22 also draws at least a portion of the cleaning fluid from the surface through the suction nozzle 42. The airflow and cleaning solution is drawn through the nozzle 42, through the hose 96 and into the air duct 146 that is attached to the bottom surface 86 of the recovery tank 30. The airflow and cleaning solution then travel through the aperture 94 in the illustrated embodiment, and travel into the recovery tank 30. In the recovery tank 30 the dirty cleaning solution is separated from the airflow, and the airflow is discharged through the aperture 90 and eventually discharged to atmosphere.

With continued reference to FIGS. 4 and 5, in the illustrated embodiment, the extractor includes the auxiliary tool inlet 114, which provides a second suction opening, and an auxiliary cover 198. The auxiliary cover 198 is rotatably coupled to the air duct 146. In a closed position, the cover 198 blocks the inlet 114 to substantially prevent an airflow from being drawn through the inlet 114 by the suction source 22. In an open position, the auxiliary cover 198 exposes the inlet 114 to allow for the auxiliary hose 78 to be inserted into inlet 114 (FIG. 5). The auxiliary hose 78 can then be used with various hand tools to clean other surfaces, such as upholstery, stairs, etc. When the auxiliary hose 78 is inserted into inlet 114, the auxiliary hose 78 blocks a suction nozzle inlet 174 of the duct 146. Therefore, when the auxiliary hose 78 is received in the inlet 114 as shown in FIG. 5, the suction source 22 generally does not draw an airflow through the suction nozzle 42.

FIG. 5 illustrates one embodiment of the air duct 146, which will be described in detail below. The illustrated air duct 146 includes an open top portion 150, a duct inlet 154 at a distal end, a duct outlet 158 at the other distal end, and walls 136 connecting the duct inlet 154 and the duct outlet 158. The air duct 146 further defines a cavity 162 in communication with the duct inlet 154 and the duct outlet 158. The air duct 146 includes a nonlinear central axis 166 that extends from the duct inlet 154 to the duct outlet 158 generally defining the longitudinal shape of the air duct 146.

The open top portion 150 includes a duct groove 170 fully enclosing a perimeter of the air duct 146. The duct groove 170 extends beyond the walls 136 away from the cavity 162. In the illustrated embodiment, the duct groove 170 is configured as a continuous perimeter around the air duct 146 with a complementary profile to a lip 130 on the tank tray 26. The lip 130 of the tank tray 26 is inserted into the duct groove 170 of the air duct 146 to provide a mating area to rigidly and fluidly bond the air duct 146 to the tank tray 26 (FIG. 5). The air duct 146 is attached to the tank tray 26 by an ultrasonic welding process. In other embodiments, the air duct 146 is attached to the tank tray 26 by other bonding processes (adhesives and other welding techniques). In other embodiments, the duct groove 170 may be configured as a non-continuous perimeter of the air duct 146. In other embodiments, the duct groove 170 may extend into the cavity 162.

The duct inlet 154 includes the suction nozzle inlet 174 in communication with the cavity 162. The suction nozzle inlet 174 extends away from the open top portion 150 and defines an inlet axis 120 (FIG. 2). The suction nozzle inlet 174 includes a threaded portion 178 configured with internal threads (FIG. 6). The threaded portion 178 couples the hose 96 (FIG. 1) to the air duct 146. Alternatively, the threaded portion 178 may be configured with external threads, or may be an opening sufficient to create a positive seal with mating suction nozzle. In addition, the duct inlet 154 includes fingers 182 adjacent the suction nozzle inlet 174 extending away from the open top portion 150. The fingers 182 include protrusions 186 generally extending laterally from the fingers 182. The protrusion 186 pivotally couple the auxiliary cover 198 to the air duct 146.

FIG. 6 illustrates the air duct 146 attached to the tank tray 26 to define a passageway 190. The passageway 190 generally follows the nonlinear central axis 166 of the air duct 146 fluidly coupling the duct inlet 154 and the duct outlet 158. In the illustrated embodiment, the air duct 146 is coupled to the bottom surface 86 of the tank tray 26. In other embodiments, the air duct 146 may be coupled to the top surface 82 of the tank tray 26 while preserving fluid communication with the recovery tank 30.

Various features and advantages of the invention are set forth in the following claims.

What is claimed is:

1. An extractor cleaning machine comprising:

a base movable along a surface to be cleaned, the base including a suction nozzle;

a body coupled to the base;

a suction source in fluid communication with the suction nozzle, the suction source operable to draw fluid and dirt from the surface through the suction nozzle;

a recovery tank configured to store the fluid and dirt drawn through the suction nozzle;

a tank tray coupled to at least one of the base and the body, the tank tray including a top surface and a bottom surface, the recovery tank coupled to the tank tray adjacent the top surface; and an air duct including a duct inlet and a duct outlet, the air duct coupled to the tank tray to define a passageway that fluidly couples the recovery tank and the suction nozzle.

2. The extractor cleaning machine of claim 1, wherein the air duct is coupled to the tank tray adjacent the bottom surface, and wherein the air duct includes an open top portion coupled to the bottom surface of the tank tray.

3. The extractor cleaning machine of claim 2, wherein the bottom surface of the tank tray defines a wall of the passageway.

4. The extractor cleaning machine of claim 1, wherein the duct inlet and the duct outlet are positioned at distal ends of the air duct.

5. The extractor cleaning machine of claim 4, wherein the air duct defines a nonlinear central axis between the duct inlet and the duct outlet.

6. The extractor cleaning machine of claim 1, wherein the body includes a handle, wherein the tank tray extends from the handle generally normal to the handle.

7. The extractor cleaning machine of claim 6, wherein the duct outlet includes an outlet axis substantially perpendicular the tank tray.

8. The extractor cleaning machine of claim 6, wherein the air duct includes a suction nozzle inlet adjacent the duct inlet defining an inlet axis substantially perpendicular to the tank tray.

9. The extractor cleaning machine of claim 8, wherein the suction nozzle inlet is fluidly coupled to the suction nozzle.

10. The extractor cleaning machine of claim 9, wherein the suction nozzle inlet includes a threaded portion.

11. The extractor cleaning machine of claim 10, wherein the threaded portion includes internal threads.

12. The extractor cleaning machine of claim 1, wherein the air duct is ultrasonically welded to the tank tray.

13. The extractor cleaning machine of claim 1, wherein the tank tray includes a lip that is received in a groove of the air duct to couple the tank tray and the air duct.

14. The extractor cleaning machine of claim 1, further comprising an aperture that extends through the tank tray, wherein the duct outlet is fluidly coupled to the aperture of the tank tray.

15. The extractor cleaning machine of claim 1, wherein a fluid-sealing gasket fluidly couples the recovery tank and the air duct.

16. The extractor cleaning machine of claim 1, wherein the tank tray further includes:

an auxiliary tool inlet adjacent the duct inlet, the auxiliary tool inlet defining a second suction opening in fluid communication with the suction source.

17. The extractor cleaning machine of claim 16, wherein an auxiliary cover is rotatable between an open position and a closed position, wherein the closed position fluidly couples the suction nozzle and the recovery tank, wherein the open position fluidly couples the auxiliary tool inlet and the recovery tank.

18. The extractor cleaning machine of claim 17, further comprising an auxiliary hose coupled to the auxiliary tool inlet when the auxiliary cover is in the open position, the auxiliary hose operable to draw fluid and dirt from the surface.

19. The extractor cleaning machine of claim 18, wherein the auxiliary hose inserted into the auxiliary tool inlet fluidly decouples the suction nozzle and the recovery tank.

20. The extractor cleaning machine of claim 1, further comprising a supply tank assembly, wherein the body includes a handle pivotally coupled to the base, and wherein the supply tank is coupled to the handle for pivotal movement with the handle relative to the base.

* * * * *